US007134878B2

(12) United States Patent
Zheng et al.

(10) Patent No.: US 7,134,878 B2
(45) Date of Patent: Nov. 14, 2006

(54) ELECTRICAL CONNECTOR

(75) Inventors: Qisheng Zheng, Kunsan (CN); Shaoping Du, Kunsan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/950,320

(22) Filed: Sep. 23, 2004

(65) Prior Publication Data

US 2005/0064738 A1 Mar. 24, 2005

(30) Foreign Application Priority Data

Sep. 23, 2003 (CN) ..... 03 2 78772

(51) Int. Cl.
*H01R 12/00* (2006.01)

(52) U.S. Cl. ..... 439/65; 439/700; 439/515

(58) Field of Classification Search ..... 439/65–71, 439/91, 515, 700, 824, 591, 500, 246–249, 439/482, 660, 862, 630
See application file for complete search history.

(56) References Cited

U.S. PATENT DOCUMENTS 4,904,213 A * 2/1990 Hock et al. ..... 439/824
5,145,384 A * 9/1992 Asakawa et al. ..... 439/78
5,509,813 A * 4/1996 Lu ..... 439/79
5,641,315 A * 6/1997 Swart et al. ..... 439/824
5,727,954 A 3/1998 Kato et al.
6,340,320 B1 1/2002 Ogawa
6,350,155 B1 * 2/2002 Mullinger-Bausch et al. ..... 439/675
6,558,177 B1 * 5/2003 Havener et al. ..... 439/246
6,716,043 B1 * 4/2004 Ishizuka ..... 439/131
6,814,626 B1 * 11/2004 Wen-Yao ..... 439/700
2002/0160637 A1 10/2002 Ishizuka

* cited by examiner

*Primary Examiner*—Truc T. Nguyen
*Assistant Examiner*—Edwin A. Leon
(74) *Attorney, Agent, or Firm*—Wei Te Chung

(57) ABSTRACT

An electrical connector (100) includes a dielectric housing, a contact terminal (3), a compression spring (4) and a retaining terminal (5). The contact terminal has a body portion (30) and a contact portion (310) extending from an upper end of the body portion. A first wing (301) and a second wing (302) perpendicularly bend from opposite edges of the body portion. The retaining terminal includes a solder portion (510) projecting beyond the housing for electrically connecting a printed circuit board and a pair of arms (53) extending from the solder portion for directly and electrically connecting with the first wing and the second wing of the contact terminal. The spring is compressed between the retaining contact and the contact terminal. An upper end of the spring engages with the contact terminal and a lower end of the spring engages with the retaining terminal.

11 Claims, 4 Drawing Sheets

ELECTRICAL CONNECTOR

BACKGROUND OF THE INVENTION

1. Field of the Invention

The present invention relates to an electrical connector and more particularly, to an electrical connector mounted on a printed circuit board or the like.

2. Description of the Prior Art

Electrical connectors are usually mounted on a printed circuit board as a component of a contact device, as disclosed in U.S. Pat. No. 5,727,954 issued to Kato on Mar. 17, 1998. In this patent, the Kato connector is of a two-part construction vertically defining a plurality of through holes. A plurality of terminals received in the through holes and each include an upper terminal normally upwardly projecting beyond a corresponding through hole, a lower terminal apart from the upper terminal and normally downwardly projecting beyond the through hole and a middle spring compressed between the upper terminal and the lower terminal. The upper terminal and the lower terminal have opposite wedge-shaped ends. The ends are inserted into opposite upper and lower coiled hollows of the spring respectively. The assembled terminal is held in the through hole such that the terminal as a whole can be axially movable relative to the assembled housing. In use, a mating electrical device (battery, memory card or printed circuit board etc.) depresses and electrically connects the upper terminal. The upper terminal electrically connects with the lower terminal via the spring positioned therebetween. The lower terminal is electrically contacted under pressure with a wiring substrate, thereby the mating device electrically connects with the wiring substrate via the electrical connector.

However, the spring may be invalidated such as distortion and resilient less after a period of use. Furthermore, the opposite wedge-shaped ends of the upper terminal and the lower terminal are inclined to get away from the coiled hollows of the invalid spring, resulting in an unreliable connection between the upper and the lower terminals. As a result, the electrical connector cannot reliably interconnect the mating device with the wiring substrate.

Hence, an improved electrical connector is needed to overcome the foregoing shortcomings.

BRIEF SUMMARY OF THE INVENTION

An object, therefore, of the present invention is to provide an improved electrical connector which can be obtain favorable interconnection, while having a relative long life-span.

In order to attain the above object, an electrical connector according to the present invention includes a dielectric housing, a contact terminal, a coiled spring and a retaining terminal. The contact terminal has a body portion and a contact portion extending from an upper end of the body portion. A first wing and a second wing perpendicular bend from opposite edges of the body portion. The retaining terminal includes a solder portion projecting beyond the housing for electrically connecting a printed circuit board and a pair of feelers extending from the solder portion for directly and electrically connecting with the first wing and the second wing of the contact terminal. The spring terminal is compressed between the retaining contact and the contact terminal. An upper end of the spring engages with the contact terminal and a lower end of the spring engages with the retaining terminal.

Other objects, advantages and novel features of the invention will become more apparent from the following detailed description when taken in conjunction with the accompanying drawings.

BRIEF DESCRIPTION OF THE DRAWINGS

The features of this invention are believed to be novel are set forth with particularly in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENT

Figure 1:
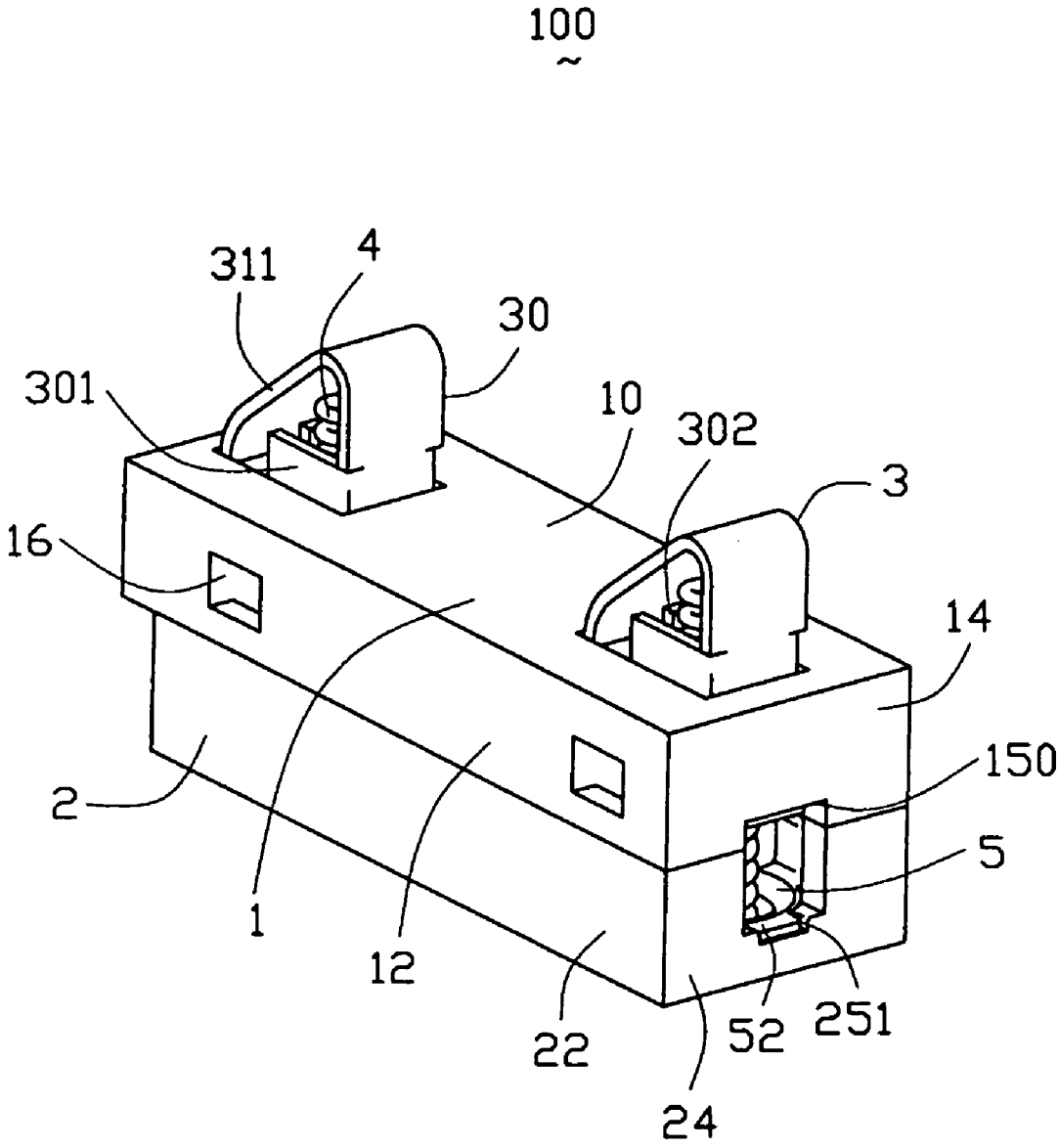
FIG. 1 is a perspective view of an electrical connector according to the present invention.
Figure 2:
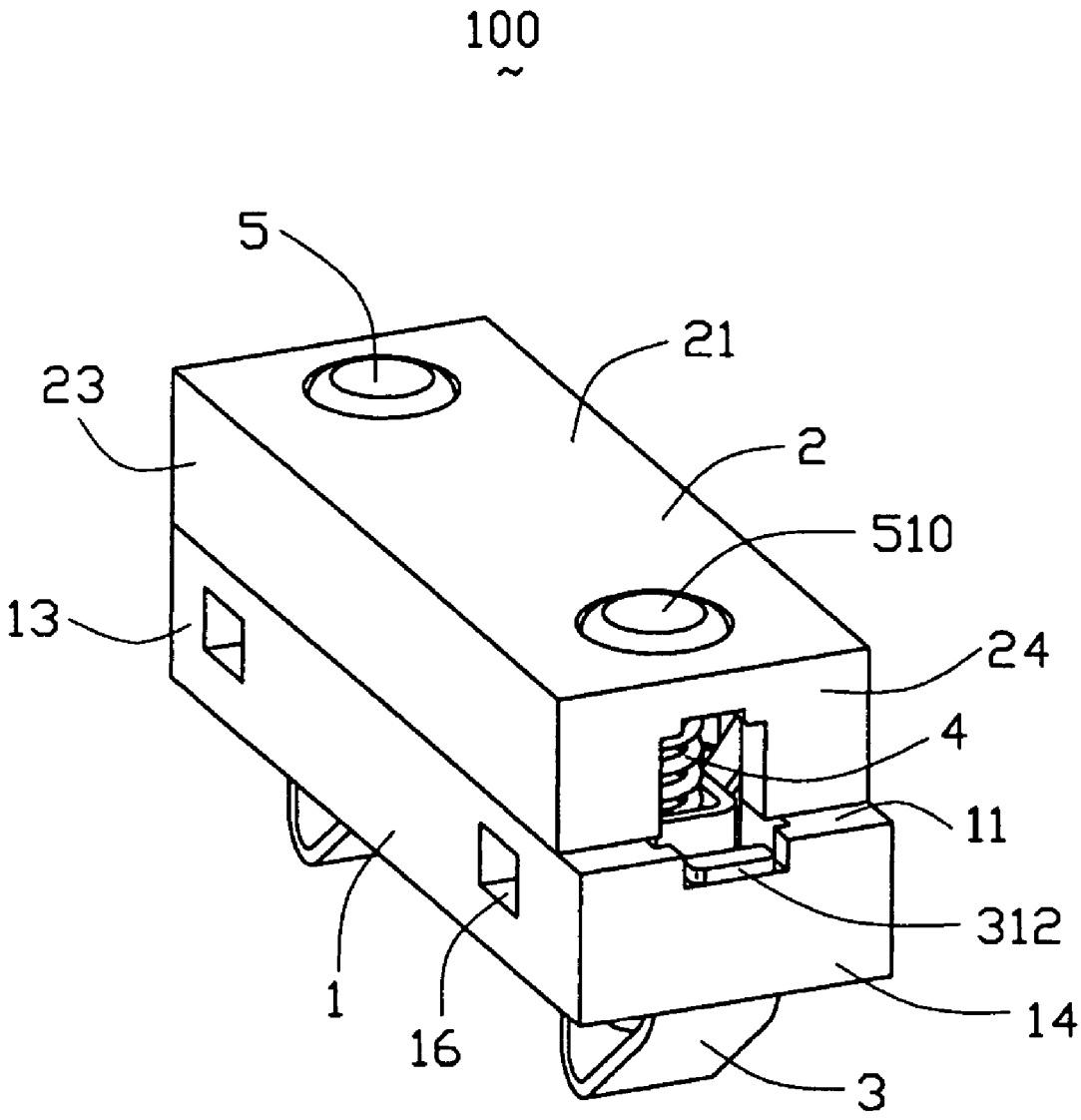
FIG. 2 is another perspective view of the electrical connector.

Referring to FIGS. 1 and 2, an electrical connector 100 in accordance with the present invention includes a first dielectric housing 1, a second dielectric housing 2 mating with the first housing 1 and a pair of contact terminals 3, springs 4 and retaining terminals 5 mounted in the assembled housings 1 and 2.

Figure 3:
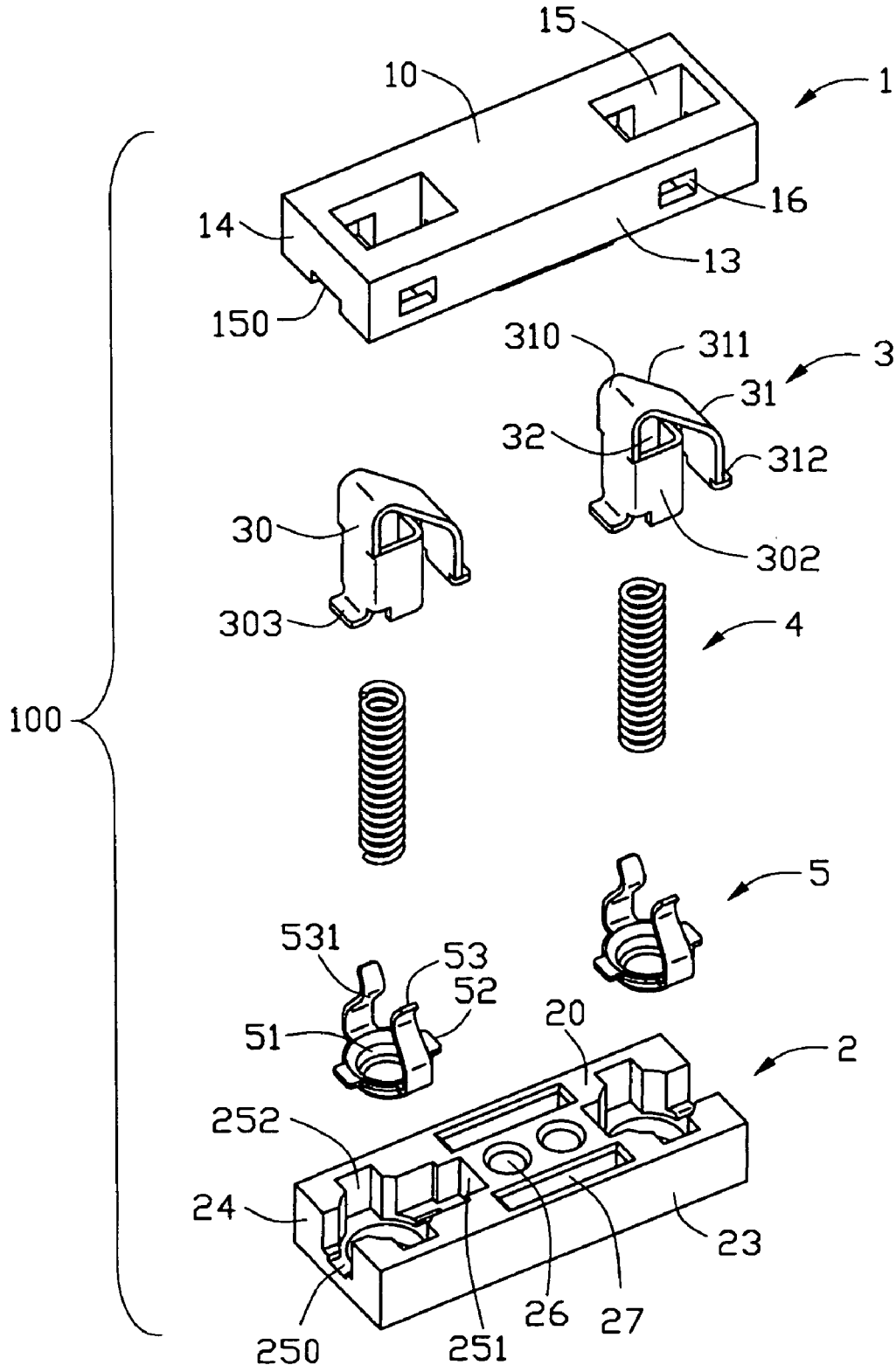
FIG. 3 is an exploded view of FIG. 1.
Figure 4:
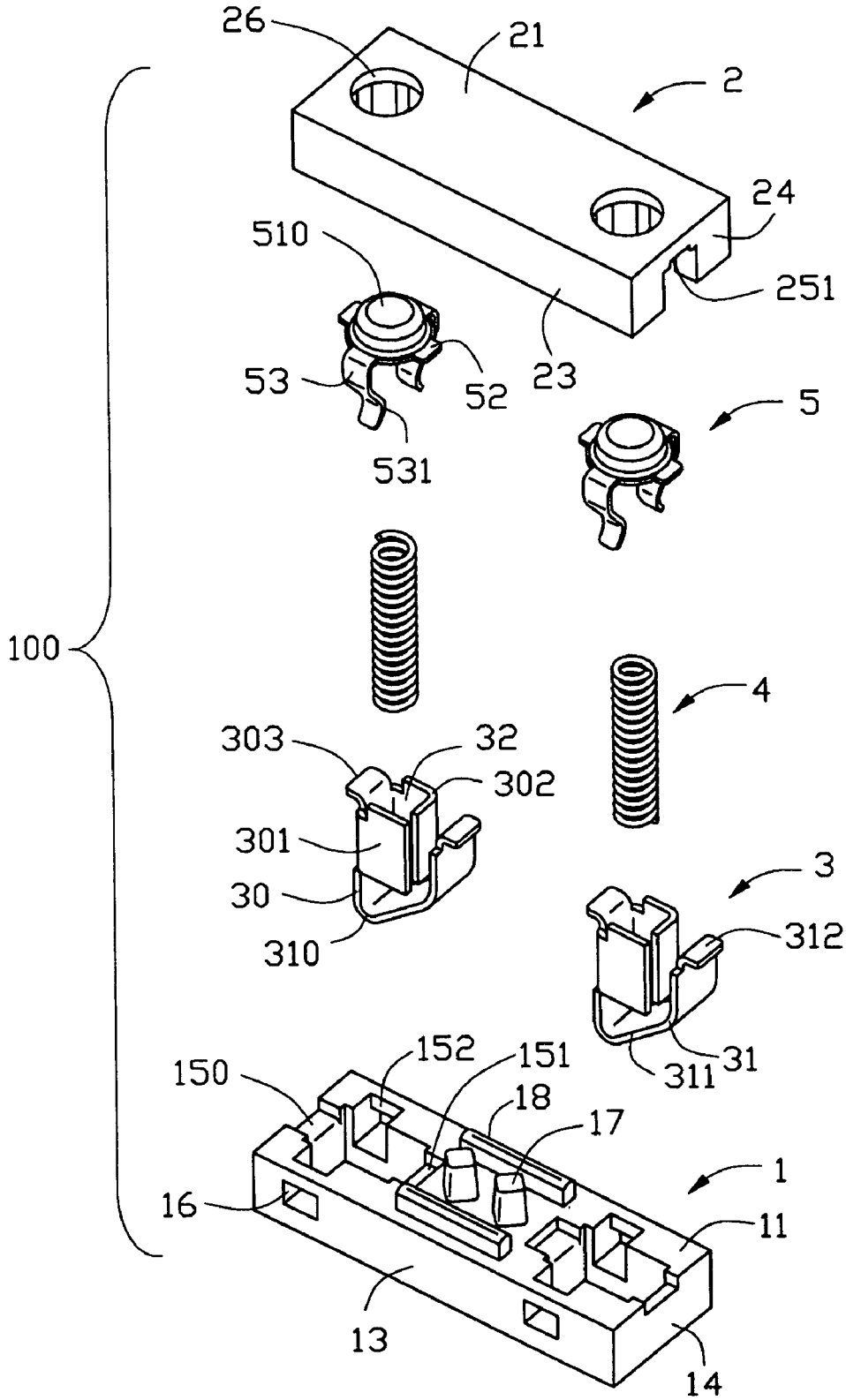
FIG. 4 is an exploded view of FIG. 2.

Referring to FIGS. 3 and 4 in conjunction with FIGS. 1 and 2, the first housing 1 has a substantially rectangle-shaped configuration and includes an upper surface 10, a lower surface 11, a front surface 12, a rear surface 13 and opposite side walls 14. A pair of first holes 15 are defined in the same direction through the upper and the lower surfaces 10, 11 and are adjacent to opposite side walls 14. Each first hole 15 is of generally rectangle-shaped adjacent to the upper surface 10 and is of generally cross-shaped adjacent to the lower surface 11. An U-shaped first indentation 150 and an U-shaped first recess 151 are oppositely defined in the lower surface 11 and communicate with the first hole 15. The first indention 150 and the first recess 151 respectively extend toward the side walls 14 and the first indention 150 extend beyond one of the side walls 14. A pair of first depressions 152 are oppositely defined in the lower surface 11 and communicate with the first hole 15. The first depressions 152 are adjacent to corresponding front and rear surfaces 12, 13 of the first housing 1. A pair of rectangular openings 16 are defined in the corresponding front and rear surfaces 12, 13 and communicate with lower portions of corresponding first depressions 152. At middle portion of the first housing 1, a pair of upright posts 17 and elongated ribs 18 downwardly and perpendicularly extend from the lower surface 11. The ribs 18 are parallel to and adjacent to the corresponding front and rear surfaces 12, 13. The posts 17 are positioned between the ribs 18.

Referring to FIG. 3 in conjunction with FIGS. 1 and 2, the second housing 2 cooperates with the first housing 1 and is slightly shorter in length than the first housing 1. The second housing 2 includes a top face 20 mating to the lower surface 11 of the first housing 1, a bottom face 21, a front face 22, a rear face 23 and opposite lateral walls 24. A pair of second holes 25 are defined in the same direction through the top and the bottom faces 20, 21 and are adjacent to the lateral walls 24 of the second housing 2 corresponding to the first holes 15 of the first housing 1. Each second hole 25 is of generally cross-shape adjacent to the top face 20 and is of generally round-shaped adjacent to the bottom face 21. An U-shaped second indentation 250 and an U-shaped second recess 251 are oppositely defined in the bottom face 21 and communicate with the second hole 25. The second indention 250 and the second recess 251 respectively extend toward the lateral walls 24 and the second indention 250 extend beyond one of the lateral walls 24. A pair of second depressions 252 are oppositely defined in the bottom face 21 and communicate with the second hole 25. The second depressions 252 are adjacent to corresponding front and rear faces 22, 23 of the first housing 2. At middle portion of the second housing 2, a pair of round holes 26 and slots 27 are defined in the top surface 20. The slots 26 are parallel to and adjacent to the front and rear faces 22, 23 for cooperating with corresponding posts 17. The round holes 26 are positioned between the slots 27 for cooperating with corresponding ribs 18 of the first housing 1.

Referring to FIG. 3 in conjunction with FIG. 4, the contact terminals 3 are stamped and each includes a substantially rectangular body portion 30 and a cantilevered beam 31 downwardly and angularly extending from a top portion of the body portion 30, thereby having a substantially V-shaped configuration. The body portion 30 has a rectangular first wing 301 and an L-shaped second wing 302 perpendicular bending toward the cantilevered beam 31 from opposite side edges thereof. The second wing 302 comprises a distal end extending between the body portion 30 and the cantilevered beam 31 and perpendicular extending to the first wing 301. The body portion 30, the first wing 301 and the second wing 302 define a receiving room 32. A tail 303 outwardly and transversely extends from a bottom edge of the body portion 30 for engaging with the first indentation 150 of the first housing 1. The contact terminal 3 has an upwardly projecting contact portion 310 on a top portion thereof for interconnecting the body portion 30 and the cantilevered beam 31. The cantilevered beam 31 comprises an outer leading face 311 extending downwardly and angularly therefrom and a horizontal extending retaining portion 312 on a lower portion thereof. A mating electrical connector (not shown) can slide upwardly along the leading faces 311 to electrically connect with the contact portions 310. The retaining portions 312 engage with the first recesses 121 of the first housing 1.

The retaining terminal 5 has a substantially dome-shaped portion (not labeled). The dome-shaped portion comprises an upwardly exposed retaining cavity 51 for receiving a lower end of the spring 4 and a soldering portion 510 on a lower surface thereof for soldering to a printed circuit board (PCB, not shown). A pair of mounting flanges 52 horizontally and symmetrically extend from the dome-shaped portion. A pair of S-shaped arms 53 upwardly and symmetrically extend from the dome-shaped portion. Each arm 53 has an inwardly projecting engaging portion 531 at a distal end thereof for directly and electrically connecting with the first and second wings 301, 302 of the contact terminal 3.

The springs 4 are coiled springs in the present invention and positioned between the contact terminals 3 and the retaining terminals 5. Each spring 4 comprises the upper end received in the receiving room 32 of the contact terminal 3 and the lower end engaging with the retaining cavity 51 of the retaining terminal 5.

Referring to FIGS. 1 to 4, in assembly, firstly, the retaining terminals 5 are installed into the second holes 25 from the top surface 20 of the second housing 2 with the dome-shaped portions of the retaining terminals 5 protruding beyond the bottom face 21. The mounting flanges 52 of the retaining terminals 5 bear against corresponding second indentations 250 and the arms 53 of the retaining terminals 5 are received in the second depressions 252 of the second housing 2 with the distal ends projecting into corresponding openings 16 of the first housing 1. The lower end of the spring 4 is inserted into the retaining cavity 51 of a corresponding retaining terminal 5. Secondly, the contact terminals 3 are upwardly inserted into the housing 1 from the lower surface 11 of the first housing 1. The retaining portions 312 of the contact terminals 3 engage with the first recesses 121 of the first housing 1 and the tails 303 of the contact terminals 3 engage with the first indentations 150 of the first housing 1. The contact portions 310 and the leading faces 311 of the contact terminals 3 project beyond the upper surface 10. Then, the pair of posts 17 and ribs 18 of the first housing 1 cooperate with corresponding round holes 26 and slots 27 of the second housing 2. The upper ends of the springs 4 enter into the receiving rooms 32 of the contact terminals 3. Therefore the first housing 1 locks with the second housing 2. Finally, the soldering portion 510 of each retaining contact 5 is soldered to the PCB so that the electrical connector 100 can electrically connect with corresponding circuit traces of the PCB.

It is important to note that in this embodiment the arms 53 of the retaining terminal 5 directly contacts with the first wing 301 and the second wing 302 of the contact terminal 3 to create an electrical path when the mating electrical connector is coupled to the subject connector 100. Owing to the structural arrangement, the electrical connector 100 as a contact device insures electrically interconnection between the mating device and the PCB even the spring terminals 4 disabled. Understandably, it is an option to have the arm 53 disengaged from the wing 301, 302 when the mating electrical connector is decoupled from the subject electrical connector, as long as the arm 53 is engaged with wing 301, 302 when the mating electrical connector is coupled to the subject connector.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

What is claimed is:

1. An electrical connector comprising:

an insulative housing subassembly defining at least one receiving space extending therethrough;

at least one contact terminal received in an upper portion of the corresponding receiving space, said contact terminal being stamped from one metal piece and defining a first coupling section, and a contact tip section for mating a complementary electronic part;

at least one retaining terminal received in a lower portion of the corresponding receiving space, said retaining terminal defining a second coupling section, and a contact end for mounting to a printed circuit board; and at least one biasing device disposed in the hosing and urging the contact terminal to move in a first direction to have said contact tip section of the contact terminal exposed above a face of the housing subassembly; wherein said first coupling section is engaged with the second coupling section when the contact tip section of the contact terminal is pressed by the complementary electronic part to resist said biasing device and the contact terminal is moved in a second direction essentially opposite to said first direction, so as to form an electrical path from the contact tip section of the contact terminal to the contact end of the retaining terminal, and wherein one of said first and second coupling sections defines a resilient terminal, and wherein one of said first and second coupling sections defines a resilient curved configuration easily moving along a plane defined by the other of said first and second coupling sections when the contact terminal is moved.

2. The electrical connector according to claim 1, wherein said biasing device is aligned with said contact terminal in said first direction.

3. The electrical connector according to claim 1, wherein said biasing device defines two ends respectively abutting against the contact terminal and the retaining terminal.

4. The electrical connector according to claim 1, wherein said housing subassembly includes a first housing defining said upper portion of the receiving space, and a second housing defining said lower portion of the receiving space.

5. The electrical connector according to claim 1, wherein the contact tip section provides an upward tapered configuration.

6. The electrical connector according to claim 1, wherein said first coupling section and said second coupling section are not constantly engaged with each other.

7. The electrical connector according to claim 1, wherein said other of the first and second coupling sections essentially circumferentially protectively encloses and surrounds the biasing device.

8. The electrical connector according to claim 1, wherein said receiving space extends through the housing subassembly in said first direction.

9. The electrical connector according to claim 8, wherein said contact terminal and said retaining terminal are essentially aligned with each other in said first direction.

10. A method of making an electrical connector, comprising steps of:

providing an insulative housing with at least one receiving space;

disposing a moveable contact terminal in an upper portion of the receiving space;

disposed a stationary retaining terminal in a lower portion of the receiving space disposing a biasing device in the housing and urging said contact terminal in a first direction; and forming a first coupling section on the contact terminal and a second coupling section on the retaining terminal; wherein the first coupling section is engaged with the second coupling section when said contact terminal is moved toward the retaining terminal in a second direction, essentially opposite to the first direction, by a complementary electronic part, and wherein one of said first and second coupling sections defines a resilient curved configuration easily moving along a plane defined by the other of said first and second coupling sections when the contact terminal is moved; wherein said other of the first and second coupling sections essentially circumferentially protectively encloses and surrounds the biasing device.

11. The method according to claim 10, wherein the first and the second coupling sections are not constantly engaged with each other.

* * * * *